US009494031B2

(12) United States Patent
Kelsall et al.

(10) Patent No.: US 9,494,031 B2
(45) Date of Patent: Nov. 15, 2016

(54) DATA TRANSMISSION DURING DRILLING

(71) Applicant: Schlumberger Technology Corporation, Sugar land, TX (US)

(72) Inventors: Neil Kelsall, Uzos (FR); Jean-Marie Degrange, Saint Martin en Bresse (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 210 days.

(21) Appl. No.: 14/274,750

(22) Filed: May 11, 2014

(65) Prior Publication Data

US 2015/0322778 A1 Nov. 12, 2015

(51) Int. Cl.
*E21B 47/16* (2006.01)
*E21B 47/12* (2012.01)

(52) U.S. Cl.
CPC ..... *E21B 47/12* (2013.01); *E21B 47/16* (2013.01)

(58) Field of Classification Search
None
See application file for complete search history.

(56) References Cited

U.S. PATENT DOCUMENTS 4,605,077 A 8/1986 Boyadjieff et al.
6,760,665 B1 * 7/2004 Francis ..... G01V 1/40 702/16
2003/0151977 A1 8/2003 Shah et al.
2004/0064258 A1 * 4/2004 Ireland ..... G01V 11/00 702/9
2009/0120689 A1 5/2009 Zaeper et al.
2010/0051292 A1 3/2010 Trinh et al.
2011/0172921 A1 * 7/2011 Valero ..... E21B 47/00 702/7
2012/0018219 A1 * 1/2012 Runia ..... E21B 7/04 175/26
2014/0129148 A1 * 5/2014 Harmer ..... E21B 47/024 702/9

FOREIGN PATENT DOCUMENTS

WO 2013000094 A1 1/2013

OTHER PUBLICATIONS

International Search Report issued in International App. No. PCT/US2015/027861, Jul. 31, 2015, 3 pages.
Written Opinion issued in International App. No. PCT/US2015/027861, Jul. 31, 2015, 10 pages.

* cited by examiner

*Primary Examiner* — Benjamin C Lee
*Assistant Examiner* — Rajsheed Black-Childress

(57) ABSTRACT

A technique facilitates efficient data transfer during a drilling operation. The drilling operation involves deploying a drill string downhole and rotating a drill bit to cut a borehole into a subterranean formation. While the drill bit is on bottom, real-time sensor data is transmitted to a surface location or other suitable location via a data transmission system. The transmission of current or real-time sensor data is stopped when the drill bit is moved off bottom. While the drill bit is off bottom, previously recorded data is sent uphole.

19 Claims, 2 Drawing Sheets

DATA TRANSMISSION DURING DRILLING

BACKGROUND

Drilling systems are employed for drilling a variety of wellbores. A drilling system may comprise a drill string and a drill bit which is rotated to drill a wellbore through a desired subterranean formation. The drill string also may comprise other components, such as a measurement-while-drilling (MWD) system and a logging-while-drilling (LWD) system. The MWD system transmits logging data to a surface location for analysis. However, the logging data sent to the surface while the drill bit is off bottom is generally discarded. The drill bit may be lifted off bottom numerous times and for a variety of reasons during a drilling operation.

SUMMARY

In general, a methodology and system are provided to facilitate efficient data transfer during a drilling operation. According to an embodiment, a drilling operation, e.g. a wellbore drilling operation, is performed by rotating a drill bit. While the drill bit is on bottom, real-time sensor data is transmitted to a surface location or other suitable location via a MWD system or other data transmission system. The transmission of current or real-time sensor data is stopped when the drill bit is moved off bottom. While the drill bit is off bottom, another type of data, e.g. previously recorded data, is sent uphole.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
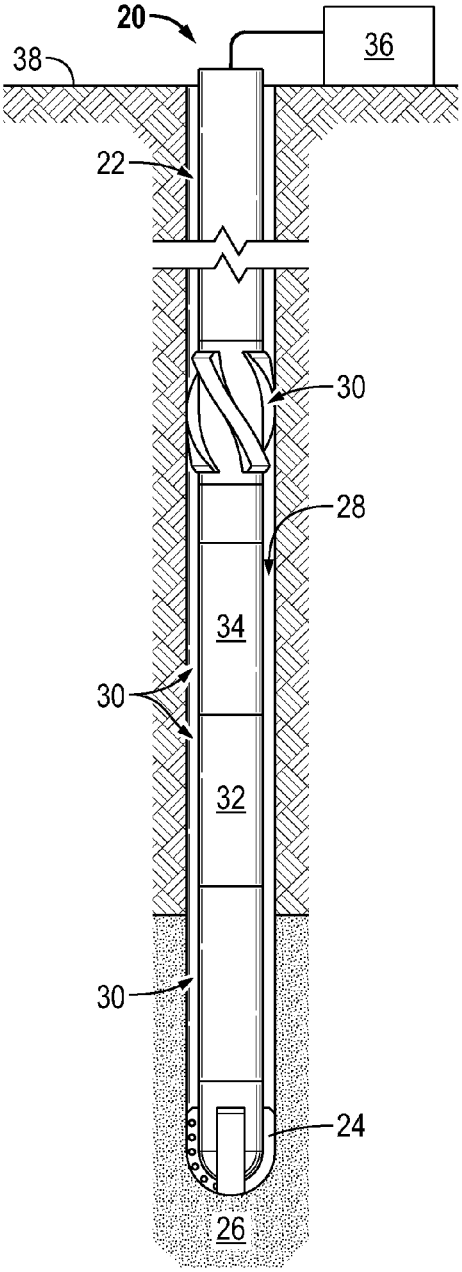
FIG. 1 is a schematic illustration of an example of a drilling system deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system to facilitate efficient data transfer during a drilling operation. Various types of drill strings may be used to drill vertical wellbores and deviated wellbores, e.g. horizontal wellbores. The drill string comprises drill pipe and other drill string components, such as a drill bit located at a lead end of the drill string. A wellbore drilling operation is performed by rotating the drill bit to cut into the formation rock, thus forming the desired wellbore. The drilling/cutting is performed when the drill bit is "on bottom" and rotated against the rock to form cuttings. While the drill bit is on bottom, real-time sensor data may be transmitted to a surface location or other suitable location via an uplink system, e.g. a MWD system or other suitable system. According to an embodiment, the transmission of current or real-time sensor data is stopped when the drill bit is moved off bottom. While the drill bit is off bottom, a different type of data may be sent uphole.

During conventional drilling, MWD logging data is discarded while the drill bit is off bottom. This off bottom condition occurs regularly when, for example, working the drill pipe up and down prior to making a drilling connection and also during circulation for wellbore cleaning. However, embodiments described herein enable ceasing of transmission of logging data while the drill bit is off bottom to enable transmission of other data, e.g. recorded measurements.

For example, the MWD tool may cooperate with sensors which enable the tool to automatically detect when the drill bit is off bottom so the MWD tool may cease transmitting logging data. During this off bottom stage, the MWD tool may be used for transmission of recorded measurements. However, once the sensor system automatically detects that the drill bit is again on bottom, transmission of recorded data may be stopped and real-time logging data may once again be sent uphole.

In some applications, the off bottom detection may be performed at the surface. For example, if the drill string uses wired drill pipe, the off bottom detection may be performed at the surface by a surface control system. In this type of application, an automated command is directly sent from the surface control system to the downhole tools during off bottom conditions. The automated command is used to request recorded station measurements or additional recorded data acquired during drilling. Once the drill bit is again on bottom and drilling resumes, an automatic command is again sent to the downhole tools to request logging data. However, embodiments described herein are particularly useful in non-wired drill pipe applications.

In non-wired drill pipe applications, the off bottom and on bottom conditions may be detected with downhole tools/sensors, and suitable commands may be provided to the MWD tool and/or other tools to commence sending the appropriate logging data or recorded data. If using MWD tools and MWD telemetry, the off bottom detection may be performed automatically downhole using a variety of sensors or combinations of sensors. For example, the off bottom detection may be determined from data provided by accelerometers, pressure sensors, integrated weight-on-bit sensors, downhole torque sensors, and/or other sensors located downhole. The sensor data also may be processed downhole by a downhole monitoring and control system.

Similarly, the downhole sensing and off bottom detection may be used in combination with seismic logging-while-drilling (LWD) tools. In the case of seismic LWD data, using automatic off bottom detection to trigger transmission of "on demand" data enables rapid transmission of, for example, previously recorded seismic waveform data to the surface. Transmission of recorded seismic waveform data may be performed during periods of off bottom circulating time, e.g. during periods of reaming prior to making a drill pipe connection and during regular circulating periods for wellbore cleaning. During certain periods, e.g. extended circulating periods, off bottom "on demand" frames plus a downlink to the seismic LWD tool enables transmission of selected memory data from the LWD tool to the surface.

Referring generally to FIG. 1, an embodiment of a drilling system 20 is illustrated. In this embodiment, drilling system 20 comprises a drill string 22 having a drill bit 24. The drill bit 24 is rotated against rock of a formation 26 to drill a wellbore 28 into or through the formation 26. The drill bit 24 may be rotated via rotation of drill string 22 from a surface location and/or via a downhole motor. Depending on the specifics of a given application, the drill string 22 may comprise a wide variety of components 30, including sensor systems, steering assemblies, downhole motors, data transmission systems, reamers, tractors, stabilizers, and/or various other components. It should be noted that although the drilling of a wellbore 28 is illustrated, the present system and methodology may be used during drilling of a variety of boreholes in well related and non-well related applications.

In the example illustrated, the drill string 22 comprises a sensor system which may include a data accumulation tool 32, e.g. a logging-while-drilling (LWD) tool 32. In some applications, the LWD tool is used to accumulate logging data during drilling, i.e while drill bit 24 is on bottom and cutting through formation 26 to form wellbore 28. The LWD tool 32 may be used to acquire various types of data, including seismic data. The logging data acquired by data accumulation tool 32 is relayed to an uplink tool 34, e.g. a measurement-while-drilling (MWD) tool 34, which transmits the data directly to the surface. For example, the MWD tool 34 may transmit the logging data to a surface control system 36 positioned at a suitable surface location 38 while the drill bit 24 is on bottom. During this on bottom drilling condition, logging data may be transmitted to surface control system 36 in real time. Various sensors may be employed with or without LWD tool 32 to determine when the drill bit 24 is on bottom.

Figure 2:
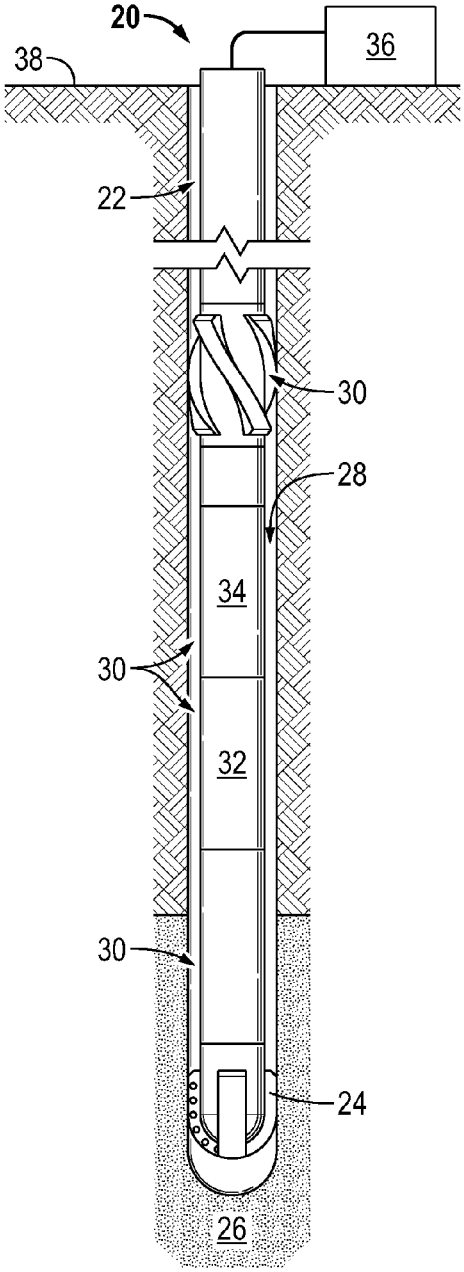
FIG. 2 is a schematic illustration of an example of a control system and sensor system which may be used to obtain sensor data indicating whether the drill bit is off bottom, according to an embodiment of the disclosure.

If the drill bit 24 is lifted off bottom, as illustrated in FIG. 2, the sensors detect this off bottom condition and provide a suitable signal to the uplink tool 34. While the drill bit is off bottom, the uplink tool 34 ceases transmission of data, e.g. logging data, to the surface. Off bottom conditions occur in many types of situations including, for example, situations involving working the drill string 22 up and down prior to making a drilling connection or during circulation for wellbore cleaning. As explained in greater detail below, the data accumulation tool 32 and/or the uplink tool 34 cooperate with downhole sensors to detect when the drill bit 24 is no longer on the bottom of the wellbore 28. (If drill string 22 comprises wired drill pipe, the "off bottom" sensors may be located at the surface.) After detecting that the drill bit 24 is off bottom, the tools 32/34 are used to send a different set of information to surface control system 36. For example, stored data, e.g. buffered or memory data, from previous station measurements may be transmitted to the surface while the drill bit 24 is off bottom.

Figure 3:
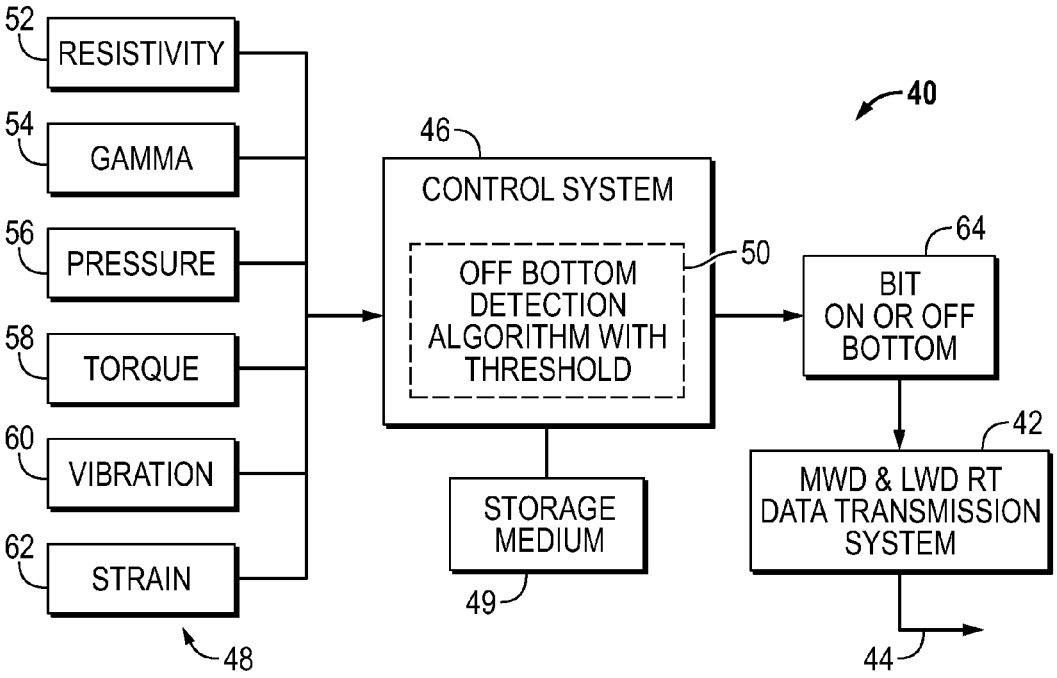
FIG. 3 is a schematic illustration of an example of a data transmission system comprising a measurement-while-drilling system and sensors employed to monitor the drill bit and to send data uphole, according to an embodiment of the disclosure.

Referring generally to FIG. 3, an example of a downhole data transmission system 40 is illustrated. In this embodiment, downhole data transmission system 40 may be incorporated with or work in cooperation with LWD tool 32 and MWD tool 34 to obtain and send data to surface control 36. For example, the overall data transmission system 40 may utilize an internal data transmission system 42 of the existing MWD tool 34 and LWD tool 32. The internal data transmission system 42 may be used to transmit data to surface control 36, as indicated by arrow 44, during both on bottom and off bottom conditions. It should be noted, however, that LWD tool 32 and MWD tool 34 are used as examples herein, and the system may utilize other types of data accumulation tools 32 and uplink tools 34.

The downhole data transmission system 40 further comprises a monitoring and control system 46 coupled with a plurality of sensors 48. By way of example, sensors 48 may comprise a sensor bank having a variety of different types of sensors constructed and positioned to obtain different types of data on, for example, drilling conditions, environmental conditions, and/or drill string component conditions. The data from these sensors 48 may be processed by the monitoring and control system 46 to determine whether drill bit 24 is on bottom or off bottom. Additionally, monitoring and control system 46 may be coupled with a downhole storage medium 49 which stores data accumulated by sensors 48 for transmission to the surface when drill bit 24 is off bottom.

By way of example, monitoring and control system 46 may be a processor-based control system able to run an off bottom detection algorithm 50 with thresholds. Algorithm 50 is selected and programmed according to the types of sensors 48 employed downhole and may use many types of data received from those sensors. Various combinations of sensor data also may be used and processed via algorithm 50 or another suitable software model/program to determine whether drill bit 24 is off bottom. Examples of suitable sensors that may be used individually or in combinations include resistivity sensors 52, gamma sensors 54, weight-on-bit/pressure sensors 56, torque sensors 58, accelerometers or vibration sensors 60, strain sensors 62, and/or other sensors positioned to obtain useful data for monitoring and control system 46.

Upon detection of the transition to an off bottom or on bottom condition, monitoring and control system 46 outputs a corresponding signal 64. Signal 64 indicates the off bottom or on bottom condition to internal data transmission system 42 of the MWD 34 tool and/or LWD tool 32. The condition of drill bit 24 is then transmitted uphole to surface control 36.

Figure 4:
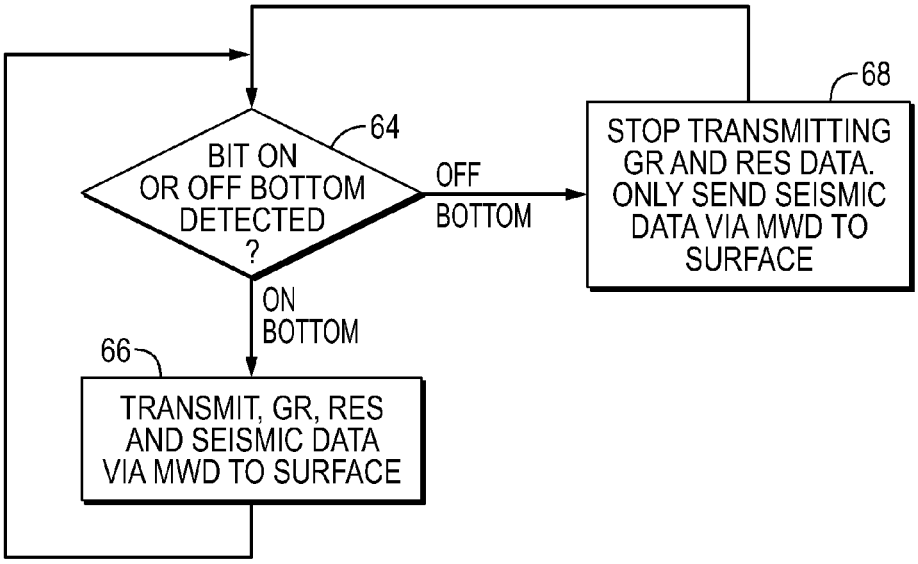
FIG. 4 is a flowchart providing an example of a data transmission technique for use during a drilling operation, according to an embodiment of the disclosure.

Accordingly, monitoring and control system 46, algorithm 50, and selected sensors 48 work in combination to detect whether drill bit 24 is on bottom or off bottom, as indicated by question block 64 of the flowchart illustrated in FIG. 4. In this example, monitoring and control system 46 is located downhole and may be part of MWD tool 34, LWD tool 32, or another downhole component 30. If a determination is made that drill bit 24 is on bottom, then a first type of data is transmitted uphole to surface control 36, as indicated by block 66. By way of example, MWD tool 34 may be used to transmit the data to surface control 36. In this example, logging data is transmitted to the surface in real time while drill bit 24 is on bottom. The specific type of data transmitted while drill bit 24 is operating on bottom may vary depending on the drilling application, but examples of such logging data include seismic data, gamma ray data, and other reservoir data.

If a determination is made that drill bit 24 is off bottom, then a second type of data is transmitted uphole to surface control 36, as indicated by block 68. By way of example, MWD tool 34 again may be used to transmit the "off bottom" second type of data to surface control 36. In this example, the transmission of real time logging data is stopped while the drill bit 24 is off bottom. Instead of transmitting logging data to the surface in real time, recorded measurements may be transmitted to surface control 36 while drill bit 24 is off bottom. The specific type of data transmitted while drill bit 24 is off bottom may vary depending on the drilling application, but examples of such recorded data include recorded seismic data, e.g. previously recorded seismic waveform data, recorded gamma ray data, and other recorded reservoir data.

In an operational example, a wellbore is drilled via a drill string having a drill bit and an uplink system, e.g. a MWD system. The uplink system is used to transmit real time logging data to a surface location during drilling. Various downhole sensors are used to detect when the drill bit is off bottom. If the off bottom condition is detected, transmission of real-time logging data ceases while the drill bit is off bottom. While off bottom, recorded measurements are transmitted to the surface via the uplink system. The downhole sensors also detect when the drill bit is once again on bottom. Upon subsequently determining the drill bit is on bottom, continuing transmission of real time data to the surface may again be commenced.

In some applications, downhole data transmission systems other than the MWD system may be used to transmit data to the surface. Additionally, logging data and/or other types of data may be transmitted from the downhole location to the surface location. The technique may be used during drilling of many types of boreholes, including well related boreholes and non-well related boreholes to provide a more efficient transfer of data to the surface.

Effectively, one type of data is transferred when the drill bit is detected as on bottom and another type of data is transferred when the drill bit is detected as off bottom. As described above, the on bottom condition may be associated with the sending of real-time data and the off bottom condition may be associated with sending of recorded data. However, the on bottom data and off bottom data may comprise other types of data depending on the parameters of a given application.

The drilling system 20 may be used in many types of drilling applications for vertical drilling, directional drilling, or other types of drilling. The system is useful in facilitating the efficient transfer of data during drilling of hydrocarbon wells, water wells, injection wells, test wells, and other types of wells. Additionally, the data transfer technique and system may be used to facilitate the transfer of data during drilling in non-well applications, including the drilling of boreholes for communication lines, passages, pipelines, and other applications.

It should further be noted that the overall configuration of the drill string 22 may vary substantially depending on the specifics of a given drilling application. A variety of drill bits and drill string components may be selected to facilitate drilling of a specific type of borehole or drilling in a specific type of environment. Additionally, the downhole control systems and the surface control systems may be processor-based systems programmed to process a variety of data types. In some applications, MWD/LWD systems may be used to collect and transfer data to the surface, however a variety of other data collection and transfer tools and systems may be employed for transmitting different types of data to the surface during different drilling conditions. The sensors, data storage devices, algorithms, and other data handling systems may vary between applications according to the specific parameters associated with each type of application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of transmitting real-time and previously recorded data in a well, comprising:

drilling a wellbore with a drill string having a drill bit and an uplink system;

providing logging data from a parameter detector located downhole with the drill string;

transmitting logging data in real-time to a well surface location via the uplink system during drilling;

detecting when the drill bit is off bottom;

ceasing transmission of the real-time logging data while the drill bit is off bottom;

transmitting previously recorded measurements from the parameter detector located downhole with the drill string via the uplink system to the well surface location while the drill bit is off bottom;

subsequently determining when the drill bit is on bottom; and upon subsequently determining the drill bit is on bottom, continuing transmission of logging data to the surface in real-time.

2. The method as recited in claim 1, wherein detecting comprises employing a sensor to detect when the drill bit is off bottom.

3. The method as recited in claim 2, wherein employing the sensor comprises employing an accelerometer.

4. The method as recited in claim 2, wherein employing the sensor comprises employing a strain sensor.

5. The method as recited in claim 2, wherein employing the sensor comprises employing a weight on bit sensor.

6. The method as recited in claim 2, wherein employing the sensor comprises employing a torque sensor.

7. The method as recited in claim 1, wherein ceasing transmission comprises sending a command signal downhole from a surface control system.

8. The method as recited in claim 7, wherein continuing transmission comprises sending a command signal downhole from a surface control system.

9. The method as recited in claim 1, wherein drilling comprises drilling the wellbore utilizing wired drill pipe in the drill string.

10. The method as recited in claim 1, further comprising lifting the drill bit off bottom when working the drill string up and down prior to making a drilling connection.

11. The method as recited in claim 1, further comprising lifting the drill bit off bottom during circulation for wellbore cleaning.

12. The method as recited in claim 1, wherein transmitting real-time data comprises transmitting real-time logging data with the uplink system in the form of a measurement-while-drilling (MWD) system; and wherein transmitting recorded measurements comprises transmitting previously recorded seismic waveform data.

13. A method of transmitting real-time and previously recorded data in a well, comprising:

drilling a borehole with a drill string having a drill bit;

providing real-time sensor data from a parameter detector located downhole with the drill string;

transmitting the real-time sensor data to a well surface location via a borehole data transmission system during drilling;

detecting whether the drill bit is off bottom;

stopping the transmitting real-time sensor data when the drill bit is off bottom;

sending previously recorded data from the parameter detector located downhole with the drill string to the surface location via the borehole data transmission system while the drill bit is off bottom; and continuing transmission of real-time sensor data when the drill bit is returned to drilling the borehole.

14. The method as recited in claim 13, wherein transmitting real-time sensor data comprises transmitting logging data.

15. The method as recited in claim 13, wherein stopping comprises sending a command signal from a downhole control system to stop the transmission of real-time sensor data.

16. The method as recited in claim 13, further comprising detecting whether the drill bit is on bottom or off bottom via a plurality of different sensors.

17. The method as recited in claim 13, further comprising interrupting the sending of recorded data and re-initiating the transmitting of real-time sensor data when the drill bit is once again on bottom.

18. A system for use in a well, comprising:

a drill string having a drill bit and a Measurement-While-Drilling (MWD) system to provide logging data of parameters located downhole with the drill string;

a control system operatively coupled with the MWD system to receive logging data during drilling of a wellbore while the drill bit is on bottom;

a sensor system positioned to detect parameters indicative as to whether the drill bit is off bottom or on bottom; and a downhole storage medium located downhole with the drill string to record data related to a reservoir located downhole in the wellbore, the MWD system transmitting the data recorded on the downhole storage medium to the control system when the sensor system indicates the drill bit is off bottom, the MWD system stopping transmission of the data recorded on the downhole storage medium and automatically resuming transmission of the logging data when the drill bit is detected to be again on bottom.

19. The system as recited in claim 18, wherein the sensor system comprises a plurality of sensors located downhole in the wellbore.

* * * * *